US005881160A

United States Patent [19]

Sheppard

[11] Patent Number: 5,881,160

[45] Date of Patent: Mar. 9, 1999

[54] CAP WITH AUDIO SYSTEM

[76] Inventor: Stanley L. Sheppard, 625 Louise St., New Iberia, La. 70560

[21] Appl. No.: 83,016

[22] Filed: May 21, 1998

[51] Int. Cl.[6] ..... H04R 25/00

[52] U.S. Cl. ..... 381/376; 381/374; 381/388

[58] Field of Search ..... 381/385, 386, 381/370, 374, 376, 380, 381, 388; 455/89, 90, 66, 351; 379/430; 2/209.1

[56] References Cited

U.S. PATENT DOCUMENTS

| | | | |
|---|---|---|---|
| 4,321,433 | 3/1982 | King | 455/351 |
| 4,357,711 | 11/1982 | Drefko et al. | 455/351 |
| 4,525,878 | 7/1985 | Lowe, Jr. | 2/185 R |
| 4,776,044 | 10/1988 | Makins | 2/199 |
| 4,833,726 | 5/1989 | Shinoda et al. | 455/90 |
| 4,858,248 | 8/1989 | Goldsmith | 2/209.1 |
| 5,404,577 | 4/1995 | Zuckerman et al. | 455/66 |
| 5,438,698 | 8/1995 | Burton et al. | 455/351 |
| 5,462,471 | 10/1995 | Power-Fardy | 446/26 |
| 5,504,943 | 4/1996 | Han | 2/209.13 |
| 5,508,699 | 4/1996 | Silverman et al. | 340/944 |
| 5,581,821 | 12/1996 | Nakano | 2/422 |
| 5,625,903 | 5/1997 | Schultz et al. | 2/209 |
| 5,678,205 | 10/1997 | Gray | 455/90 |

*Primary Examiner*—Sinh Tran
*Attorney, Agent, or Firm*—Henderson & Sturm

[57] ABSTRACT

A cap positionable over the head of the user having a tape playing apparatus, and at least one speaker positionable near the ear openings of the wearer for playing desired tapes in a comfortable fashion while the wearer is sleeping. The tape plying apparatus is positioned at the crown of the cap to allow the user to sleep comfortably when the cap is in use.

4 Claims, 1 Drawing Sheet

CAP WITH AUDIO SYSTEM

BACKGROUND OF THE INVENTION

1. Field of the Invention

The present invention relates to the field of headgear, and more particularly to a cap having an incorporated audio system.

2. Description of Related Art

As can be seen by reference to the following U.S. Pat. Nos. 4,525,870; 5,438,698; 5,462,471; 5,504,943; 5,581,821; and 5,625,903, the prior art is replete with myriad and diverse headgear with audio components.

While all of the aforementioned prior art constructions are more than adequate for the basic purpose and function for which they have been specifically designed, they are uniformly deficient with respect to their failure to provide a simple, efficient, and practical headgear with an audio system suitable for playing while sleeping.

As a consequence of the foregoing situation, there has existed a longstanding need for a new and improved cap with an audio system and the provision of such a construction is a stated objective of the present invention.

BRIEF SUMMARY OF THE INVENTION

Briefly stated, the present invention provides a cap positionable over the head of the user having a tape playing apparatus, and at least one speaker positionable near the ear openings of the wearer for playing desired tapes in a comfortable fashion while the wearer is sleeping. The tape plying apparatus is positioned at the crown of the cap to allow the user to sleep comfortably when the cap is in use.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
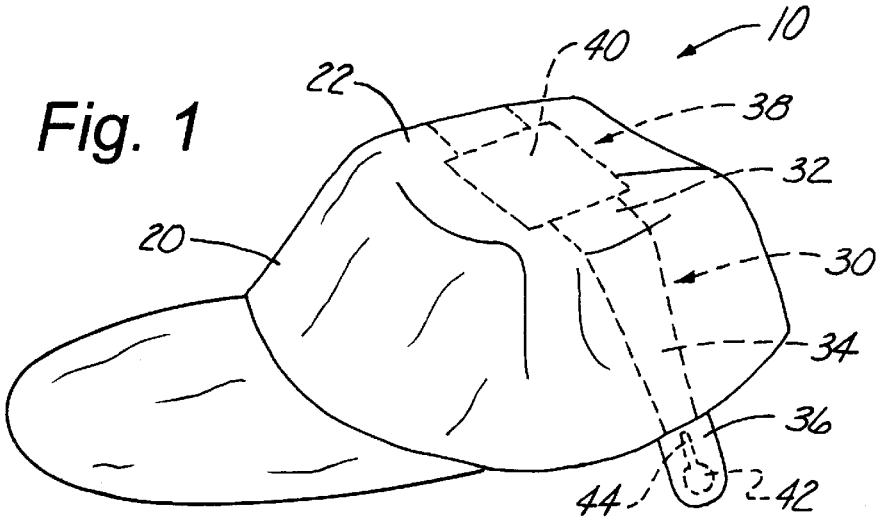
FIG. 1 is a perspective view of one embodiment of the present invention suitable for use by an adult.
Figure 2:
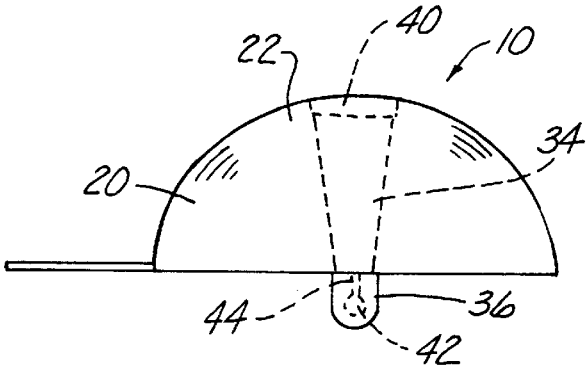
FIG. 2 is a side elevational view thereof.
Figure 3:
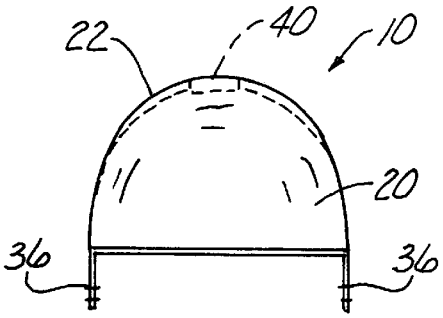
FIG. 3 is a rear elevational view thereof.

As can be seen by reference to the drawings, and in particularly to FIG. 1, the audio cap that forms the basis of the present invention is designated generally by the reference number 10. The audio cap 10 includes a cap 20 positionable over the head of the user, and a support bracket 30 attached by Velcro or other suitable means to the interior of the cap 20. The bracket 30 includes an upper section 32 secured to the crown 22 of the cap 20, and side sections 34 extending down to a location near the ears of the user. A cloth ear piece 36 is attached to the lower end of each side section 34. A pocket 38 is carried on the upper section 32 to receive an audio device 40 such as a small radio or tape player. Speakers 42 are secured to the interior of the cloth ear pieces 36 and speaker wires 44 interconnect the audio device 40 and the speaker 42. The embodiment illustrated in FIGS. 1–3 is adapted for use by adults.

Figure 4:
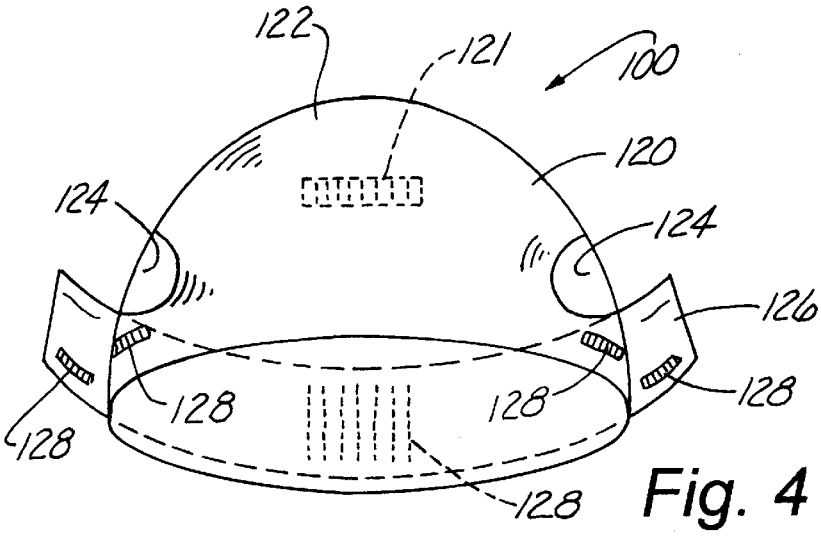
FIG. 4 is a perspective view of a second embodiment of the present invention suitable for use by an infant or child.

The audio cap 100 illustrated in FIG. 4 is adapted for use on infants. The infant audio cap 100 includes a cap 120 positionable over the head of an infant and a Velcro strip 121 attached to the interior of the cap 120 at the crown 122. Side openings 124 are formed in the cap 120 at a location above the ears of the infant. The bracket 30, as described above, is attached to the Velcro strip 121 and the lower ends of the side sections 34 extend through the side openings 124 such that the cloth ear pieces 36 extend below the lower edge of the cap 120 to a position over the ears of the infant. A liner 126 wraps around the cap 120 to cover the side openings 124 and hold the lower ends of the side sections 34 and cloth ear pieces 36 in position. The liner is secured by Velcro fasteners 128 on the cap 120 and liner 126, respectively. The audio cap 100 is a developmental aide for an infant which utilizes a cassettes tape player system 40. The audio cap 100 provides neurosensusal stimulation to an infant which provides a two-fold benefit; it is a teaching aid and with music it acts as sleeping aid. The audio cap 100 serves as a catalyst for early brain development and in addition provides security to the infant. Taped subjects include lullaby type music, stories, religious, or basic learning fundamentals such as ABC's etc. This concept is also adapted as an adult audio cap 10 to aid in sleeping, exercising, learning by tape, etc.

In use, the user would simply insert the cassette of choice into the audio cap 100. They would push the play button and install the cap 100 onto the infant's head. The tape would play soothingly to the infant, and either help him to learn, or soothe him to sleep, depending on the type of material that was playing on the tape. This provides neurosensusal stimulation to the infant. This would aide in his development as he would at a very early age be exposed to a variety of music, teaching material, and if desired, religious material. By routine use at bedtime, the child would become accustomed to having the stimulation, and would soon develop a much better sleeping pattern. Due to the unique design, all components are tucked away out of sight, with no exposed wires that the infant could pull on, or chew on. The audio cap 100 provides a very convenient and easy-to-use method of stimulating a child's mental growth, while also providing the best possible sleep time for the infant.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An audio cap, comprising:

a cap including a crown, a lower edge, and an interior and exterior surface;

a support bracket attached to the interior surface of the cap, the bracket including an upper section attached to the crown of the cap, the upper section having a pocket adapted to receive an audio device, the bracket further including side sections with lower ends extending down from the upper section to the lower edge of the cap;

ear pieces attached to the lower ends of the side sections of the bracket; and speakers electrically connected to the audio device and being disposed within the ear pieces.

2. The audio cap of claim 1 wherein the ear pieces are cloth.

3. The audio cap of claim 1 wherein the cap further includes side openings, and wherein the side sections of the bracket extend out through the side openings.

4. The audio cap of claim 3 further including a liner releasably attachable to the cap and disposed to cover the side openings after the side sections of the bracket extend therethrough.

* * * * *